United States Patent [19]

Jackson et al.

[11] Patent Number: 4,771,529

[45] Date of Patent: Sep. 20, 1988

[54] APPARATUS FOR TRAMMING RAILWAY TRUCKS

[75] Inventors: Keith L. Jackson, Creve Coeur; Richard B. Polley, St. Charles, both of Mo.; Dallas L. Schmitt, Belleville, Ill.

[73] Assignee: GSI Engineering, Inc., St. Louis, Mo.

[21] Appl. No.: 124,669

[22] Filed: Nov. 24, 1987

[51] Int. Cl.[4] ..... E04B 2/00

[52] U.S. Cl. ..... 29/281.5; 29/271; 105/157.1; 105/224.1

[58] Field of Search ..... 105/182.1, 218.1, 219, 105/463.1, 198.2, 157.1, 224.05, 224.06, 224.1; 269/47, 309; 279/6; 29/271, 281.5

[56] References Cited

U.S. PATENT DOCUMENTS

| | | | |
|---|---|---|---|
| 3,839,969 | 10/1974 | Thum | 105/224.1 |
| 3,877,387 | 4/1975 | Kasai et al. | 105/157.1 |
| 4,067,261 | 1/1978 | Scheffel | 105/157.1 |
| 4,140,305 | 2/1979 | Rabin | 269/47 |
| 4,151,801 | 5/1979 | Scheffel et al. | 105/224.1 |
| 4,191,366 | 3/1980 | Rabin | 269/47 |
| 4,598,453 | 7/1986 | Wills | 269/47 |
| 4,626,299 | 12/1986 | Knight et al. | 29/281.5 |

*Primary Examiner*—Robert B. Reeves

*Assistant Examiner*—Joseph D. Pape

*Attorney, Agent, or Firm*—F. Travers Burgess

[57] ABSTRACT

Apparatus for tramming the wheel and axle assemblies of railway trucks having sideframes and a transverse frame member supported on sideframes, the sideframes being supported at their ends on structures carried on the end portions of the axles, including a fixture having apertures defining the trammed positions of the journal boxes, vertical axis cylindrical apertures in the end portions of the sideframes adapted for general vertical alignment with the fixture apertures, cylindrical bushings rotatably mounted in the sideframe apertures and having off center internal apertures, pins rotatably mounted in the bushing internal apertures and having off center internal apertures, pins rotatably mounted in the bushing internal apertures and having an eccentric extension at their lower ends, whereby irrespective of misalignment of the sideframes, the pin extensions are alignable with and insertable in the fixture apertures, said bushings and pins being lockable in the resulting trammed positions and their eccentric extensions, the axle supported structures being formed with apertures for closely receiving the pin eccentric extensions and thereby fixing the wheel and axle assemblies in trammed relation.

4 Claims, 4 Drawing Sheets

APPARATUS FOR TRAMMING RAILWAY TRUCKS

BACKGROUND OF THE INVENTION

1. Field of the Invention

The invention relates to railway rolling stock and comprises a method and apparatus for tramming the wheel and axle assemblies of railway vehicle trucks having separate sideframes supporting and connected by a main frame.

2. The Prior Art

In prior three-piece trucks, which have principally been furnished for freight service, maintaining the trucks in tram has been attempted by interfitting, as closely as practical, opposing surfaces of the sideframes and main transverse frame member, as in the typical spring plankless freight car truck wherein tram maintenance is attempted by initially close-fitting sliding engagement between the bolster and column guide surfaces. Perfect initial tramming of such trucks would require very close tolerance machining of bolster and column guide surfaces and maintenance of perfect tram in such trucks would be difficult because of frictional wear on the opposing surfaces. In trucks of the type in which the main frame is supported, for example, by elastomeric sandwiches, as in F.W. Sinclair patent No. 2981208, extreme precision is also required in the manufacture of the sideframe and bolster interfaces and the sandwich devices and in the assembly of these parts. Manufacturing and assembling these parts to the very close tolerances required for accurate tramming is so costly as to be impractical.

SUMMARY OF THE INVENTION

An object of the invention is to provide means for precisely tramming the wheel sets of a railway truck of the three-piece frame type having separate sideframes supported on the axles and supporting a transverse main frame, without requiring manufacture of the truck frame parts and assembly of the truck frame to extremely close tolerances.

A further object is to provide such means which are further capable of replacing wheel sets in fully trammed position on such trucks in the field without modification of the truck framing or performing field tramming procedures.

DETAILED DESCRIPTION OF THE INVENTION

Figure 1:
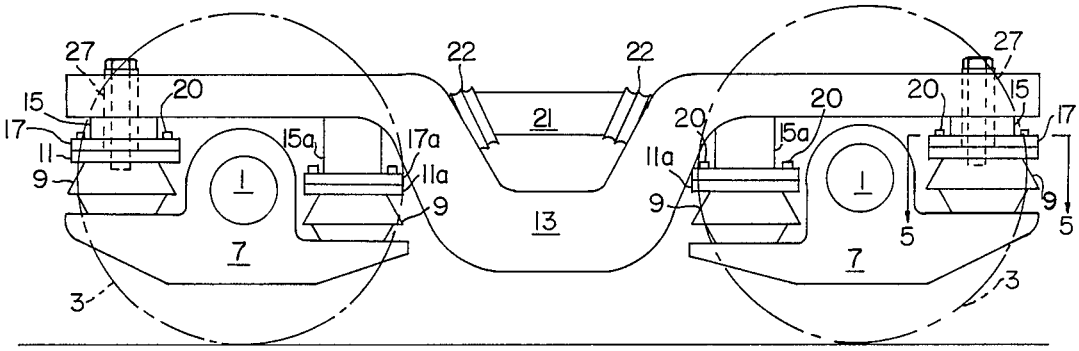
FIG. 1 is a side elevational view of a truck constructed for tramming in accordance with the invention.

The railway vehicle truck illustrated in the drawings comprises a pair of longitudinally spaced parallel axles 1, a pair of gauged flanged wheels 3 mounted on the end portions of each axle, and structures carried by the end portions of each axle comprising bearings rotatably receiving each axle inboard of the respective wheels, and each fixedly mounting a pair of longitudinally spaced vertically resilient spring devices 9 having square cap flanges 11 and 11*a* each formed at its corners with bolt holes 12 for underlying attachment to sideframes 13. Each sideframe 13 has at its opposite ends a pair of depending pedestals 15 terminating in square flanges 17 with oversized bolt holes 19 at its corners adapted for registry with the bolt holes 12 in spring cap flanges 11 of the spring devices 9 nearest the ends of the respective sideframe 13. Similar depending pedestals 15*a* with flanges 17*a* are provided for securement of spring cap flanges 11*a* of the other spring device on each bearing box 7. Bolts 20 in aligned sideframe pedestal and spring device bolt holes 12 and 19 secure the sideframe to the bearing boxes.

In addition to sideframes 13, the truck framing assembly includes transverse main frame member 21 carried by the sideframes and in substantially fixed relation to the sideframes in the horizontal plane. The main frame may be supported from the sideframes by inclined elastomeric pad devices 22 and positioned transversely with respect to the sideframes by longitudinally spaced lateral thrust devices (not shown). It will be evident that if, in the initial assembly of the framing, the sideframes and transverse frame are not in perfect trammel with each other, the spring device attachment flanges 17 and 17*a* will be correspondingly out of trammel.

Figure 6:
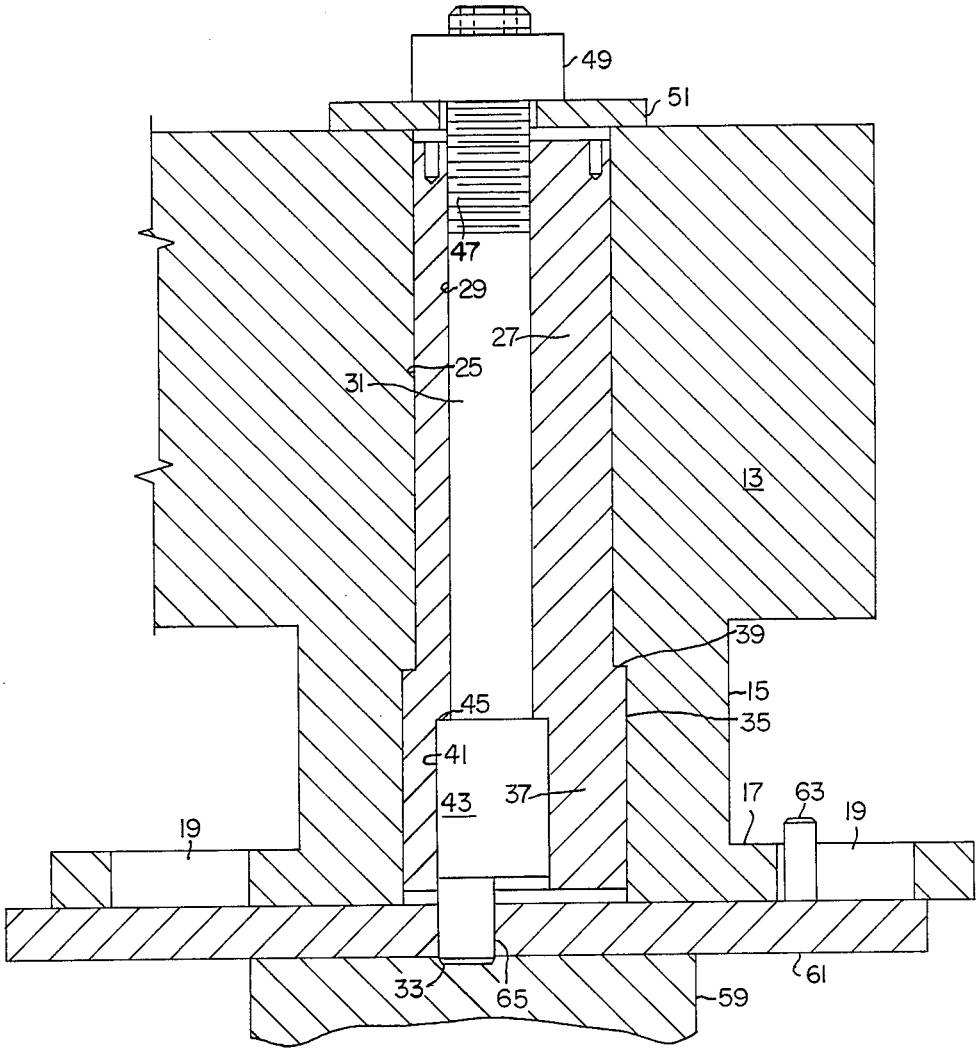
FIG. 6 is an enlarged longitudinal vertical sectional view similar to FIG. 3 but showing the relationship of sideframe and tramming fixture interfacing parts in tramming position.

In order to ensure that the wheel and axle assemblies 3, 1 will be placed in tram irrespective of possible imperfect tramming of the framing assembly, the end spring cap flanges 11 are formed with a central tramming hole 23, and, as best seen in FIG. 6, each sideframe 13 end portion and pedestal 15 is formed with a central vertical cylindrical aperture, bore 25, in which is rotatably received a double eccentric tram pin assembly comprising cylindrical bushing 27 having an eccentric bore 29 and a pin 31 rotatably received in bore 29 and formed at its lower end with an eccentric extension 33 adapted to fit closely into the tramming hole 23 in the cap flange 11 of the respective spring device, so that the position in the horizontal plane of the spring device cap flange 11 with relation to the respective sideframe can be varied both transversely and longitudinally of the truck by rotation of bushing 27 and pin 31.

The lower end portions of bore 25 and bushing 27 are correspondingly enlarged to provide opposing shoulders 39 and the lower end portions of bushing bore 29 and pin 31 are similarly enlarged at 41 and 43 respectively to provide opposing shoulders 45.

Shoulders 39 and 45 prevent upward movement of bushing 27 in the sideframe bore 25 and of pin 31 in bushing 27, and the upper end of pin 31 is threaded as at 47 and projects upwardly from the respective sideframe 13. A tamper-proof locknut on the projected threaded portion 47 of pin shaft 31 and a washer 51 cooperate with shoulders 39 and 45 to hold the tram pin assembly together and, when desired, as will be seen hereinafter, to lock the pin extension 33 in tramming position.

Figure 4:
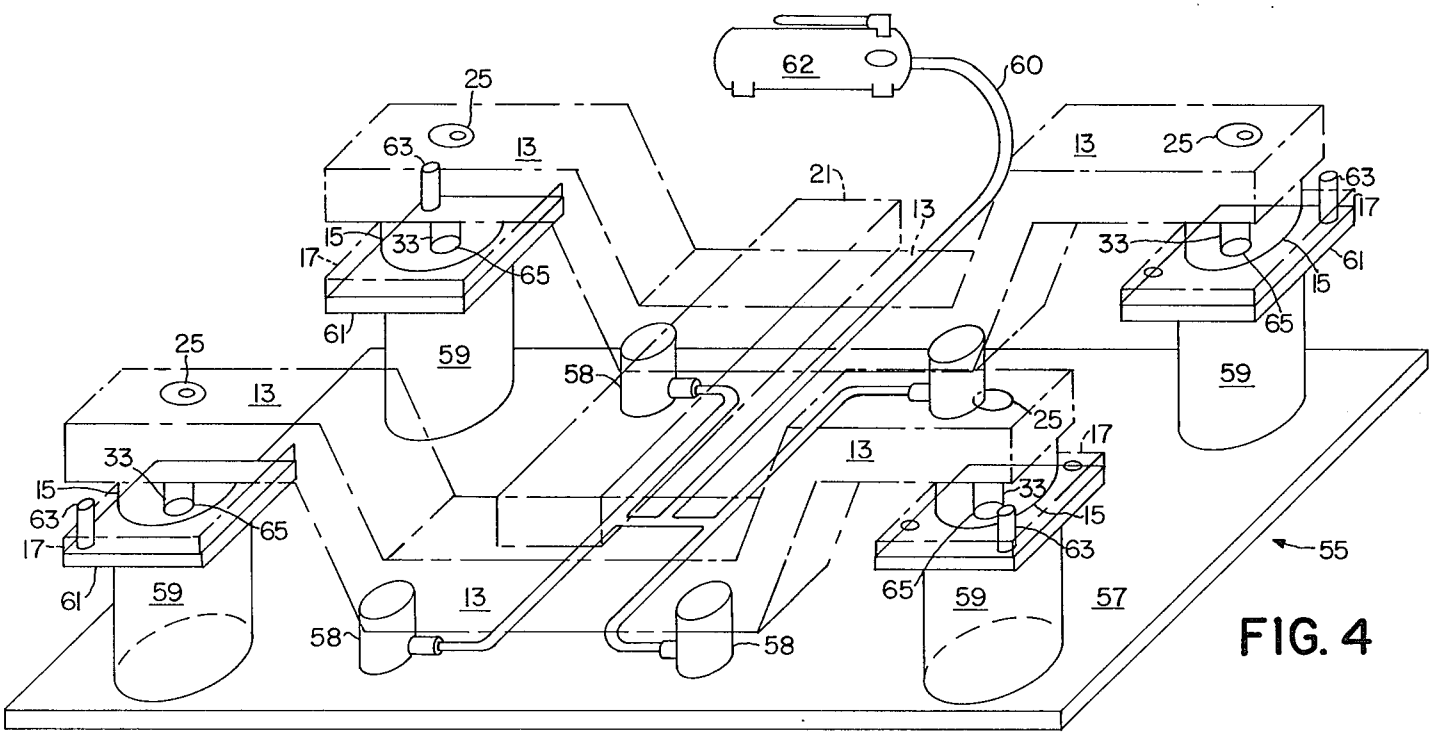
FIG. 4 is a perspective view of tramming apparatus embodying the invention with a truck frame in tramming position thereon.
Figure 5:
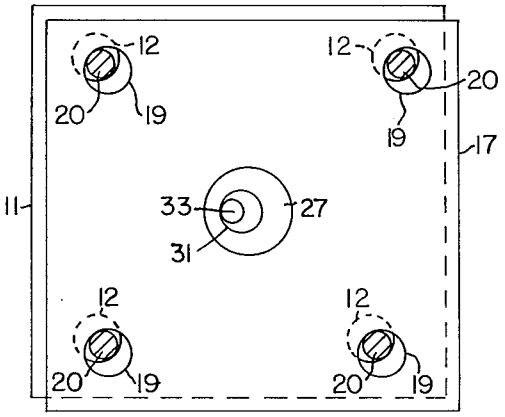
FIG. 5 is an enlarged top view taken from line 5—5 of FIG. 1 showing the trammed relationship of the sideframe and primary spring interfacing parts.

For positioning pins 33 in trammed relation with each other, the tramming fixture generally indicated at 55 in FIG. 4 comprises a bed plate 57 on which are fixedly mounted four upright pedestals 59 with flat square caps 61 each having an upstanding pin 63 at its outermost corner and a central hole 65 of sufficient size to closely receive tramming pin extension 33, holes 65 being located to define a rectangle corresponding to the correctly trammed positions of the truck spring cap plates 11.

Bedplate 57 mounts four hydraulic jacks 58 connected by lines 60 to a hydraulic pump 62, for supporting flange plates 17 of the assembled truck framing vertically clear of fixture pins 63.

Pins 63 are of sufficiently smaller diameter than holes 19 in the bottom flange 17 of sideframe pedestals 15 to fit into the corresponding holes 19 whereby to position flanges 17 generally with respect to the tramming fixture caps 61, so that if the truck framing assembly is positioned over the tramming fixture and lowered by jacks 58 to a predetermined height, approximately ½ inch above tramming fixture pedestal caps 61, pins 63 will generally locate the sideframe pedestal flanges 17 with relation to pedestal caps 61.

Figure 2:
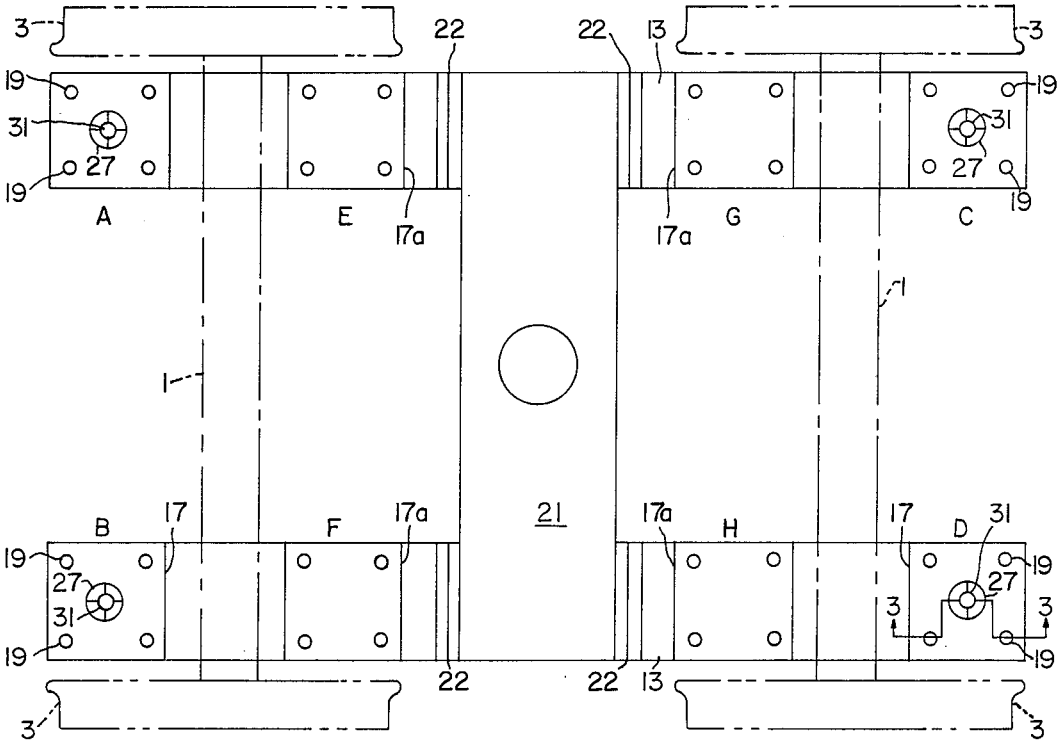
FIG. 2 is a simplified plan view of a truck of the type illustrated in FIG. 1 showing the double eccentric tram pin.
Figure 3:
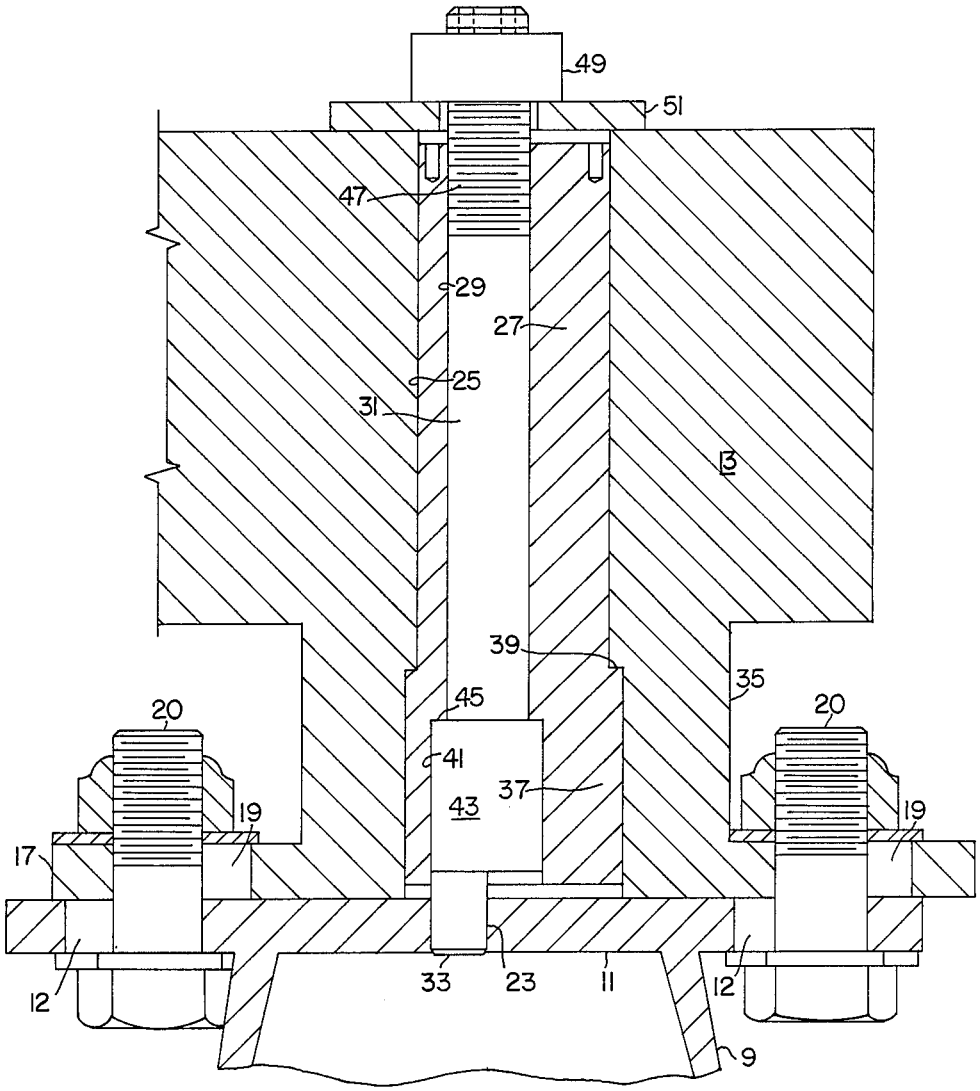
FIG. 3 is an enlarged fragmentary longitudinal vertical sectional view taken along line 3—3 of FIG. 2.

When this occurs, by removing the nut from pin 31 at position A as seen in FIG. 2, and manually rotating bushing 27 in the respective sideframe bore 25 and tram pin 31 in bushing bore 29 until the respective tram pin extension 33 drops into the respective hole 65 in fixture flange plate 61, and by repeating the same procedure at positions B, C and D, tram pin extensions 33 will be in the same positions relative to each other as holes 65 in the tramming fixture pedestal caps 61 and will define the same rectangle, in plan, as holes 65 in tramming fixture. Hydraulic pressure in jacks 58 is then relieved permitting the framing assembly to rest on tramming fixture pedestal caps.

By installing washer 51 and tamper-proof locknut 49 on eccentric tram pin threaded portions 47 and torquing the locknuts until the breakaway head shears off, the tram pins 31, 33 are locked in tramming position from which they cannot be removed or repositioned except by removal of locknut 49 with a special tool.

After tram pins 31, 33 have been correctly positioned and locked in tramming relation with each other, truck framing assembly 13, 13, 21 is lifted off the tramming fixture and lowered onto the spring cap flanges 11 and **11*a* of the wheel and axle assemblies 1, 3, positioning the latter until tramming holes 23 are in registry with tram pin extensions 33, inserting tram pin extensions 33 in the center tramming holes 23 of the spring device cap flanges 11 of the outer springs 9 at locations A, B, C and D, and lowering the truck frame assembly until its flanges 17 are resting on primary spring flanges 11**.

With the spring devices 9 so positioned and the wheel and axle assemblies 1, 3 consequently in trammel with each other, four bolts 20 are inserted in the enlarged bolt holes 12 and 19 of the respective pairs of pedestal and spring device flanges 17 and 11, and **17*a* and 11*a*, nuts are applied to bolts 20** and are torqued to secure the sideframes to the primary spring devices and thence to the bearing boxes and wheel and axle assemblies.

In the event a wheel and axle assembly must be replaced, no field tramming procedure is required because of the fixed position of tramming pins 31, 33, and the fixed locaton of the springs on the bearing boxes, the wheel and axle assembly being applied in the same manner as described above.

OPERATION OF THE INVENTION

Double eccentric tram pin assemblies 27, 31 are inserted in each of the four corners of the completed truck frame assembly at points A, B, C and D and nut 49 is installed finger-tight on each eccentric tram pin 31 to hold the tram pin assemblies in place temporarily. Hydraulic jacks 58 are then elevated to their full heights and the frame assembly is lowered toward the tramming fixture, utilizing the single locator pin 63 on each of the four tramming fixture outer pedestal flanges 61 as a rough positioning guide within the frame assembly oversize bolt holes 19, traming fixture locator pins 63 being of smaller diameter than frame assembly bolt holes 19.

With the frame assembly supported by hydraulic jarks 58, a small distance—about ½ inch—above the tramming fixture outer pedestal top plates 61, nut 49 is removed from eccentric tram pin 31 at position A, allowing pin 31 to drop down against the tramming fixture pedestal 61 and the eccentric bushing 27 and pin 31 are rotated until pin eccentric extension 33 registers with and drops into tramming fixture pedestal hole 65.

This procedure is repeated at positions B, C and D, after which hydraulic jacks 58 are lowered, allowing the sideframe flange plates 17 to rest on the fixture flange plates 61, and eccentric tram pin assemblies 27, 31 are locked in this position by torquing lock nuts 49. The truck framing assembly is then lifted off of the tramming fixture and lowered so that pedestal flanges 17 and **17*a* rest on spring cap flanges 11 and 11*a*, with tramming pin extensions 33 received in tramming pin holes 23 in the respective spring cap flanges 11**.

The wheel and axle assemblies are now in trammed relation with each other irrespective of irregularities in the truck framing assembly, and are secured in aligned position by bolts 20 in the enlarged bolt holes 12 and 19 of the sideframe pedestal flanges 17 and **17*a* and spring cap flanges 11 and 11*a***.

If replacement of wheel and axle assemblies in the field is required, no further tramming is necessary because when the replacement wheel and axle assemblies are applied, the tramming pins 33 will fix them in fully trammed positions.

The details of apparatus and method disclosed herein may be varied substantially without departing from the spirit of the invention and the exclusive use of all such modifications as come within the scope of the appended claims is contemplated.

We claim:

1. Apparatus for tramming a railway vehicle truck having a pair of wheeled axles, a truck frame assembly comprising longitudinally extending sideframes and a transverse member supported on said sideframes and structures supporting said sideframes at their ends from said axles including journal bearings rotatably receiving the end portions of said axles, comprising:

(a) opposed downwardly and upwardly facing horizontal interfaces on said sideframes and said sideframe supporting structures securable to each other for fixing said sideframes and the axles with relation to each other in the horizontal plane;

(b) a fixture having upwardly facing surface means abuttingly engageable with the downwardly facing interfaces on said sideframes and at least four upwardly open recesses in said surface means defining the corners of a rectangle;

(c) four vertical-axis double eccentric devices positioned in the end portions of said sideframes and terminating in depending projections closely receivable in said recesses, said eccentric devices being rotable to align said projections with said recesses irrespective of misalignments of side sideframes from trammed relation and being permanently lockable in such aligned positions;

(d) said upwardly facing horizontal interfaces on said sideframe supporting structures having accurately located recesses adapted to closely receive said depending projections and thereby position said wheeled axles in tram with each other.

2. Apparatus according to claim 11 wherein said sideframe and sideframe supporting structure interfaces have a plurality of generally aligned holes, and bolts through said holes are utilized to secure said journal bearing supported structure and sideframe interfaces to each other, said holes being of substantially larger diameter than said bolts whereby to accommodate horizontal offsets of said sideframe supporting structure interfaces from said opposing sideframe interfaces in accordance with the trammed positions of said depending projections.

3. Apparatus according to claim 2 wherein said fixture is formed with upstanding locating pins receivable in one of the bolt holes in each sideframe interface, said pins being of less diameter than said bolt holes whereby to permit limited horizontal shifting of said sideframe interfaces with respect to said fixture to accommodate positioning of said depending projections into alignment with said fixture upwardly open recesses.

4. Apparatus according to claim 3 wherein said fixture includes jacks positioned for underlying engagement with said sideframes and means for operating said jacks in unison to lower said frame assembly uniformly onto said fixture for alignment of said depending projections with upwardly open recesses in said fixture.

* * * * *